United States Patent [19]

Yokoe

[11] Patent Number: 4,739,945

[45] Date of Patent: Apr. 26, 1988

[54] SPOOL FOR WINDING THEREON FLEXIBLE ELONGATE MATERIALS

[75] Inventor: Kazuo Yokoe, Kurobe, Japan

[73] Assignee: Yoshida Kogyo K. K., Tokyo, Japan

[21] Appl. No.: 38,665

[22] Filed: Apr. 15, 1987

[51] Int. Cl.[4] ..... B65H 75/14; B65H 75/18; B65H 75/28

[52] U.S. Cl. ..... 242/118.41; 242/71.8; 242/74; 242/118.61

[58] Field of Search ..... 242/118.41, 118.4, 118.6, 242/118.61, 118.7, 71.8, 74, 56.9, 18 R

[56] References Cited

U.S. PATENT DOCUMENTS

| | | | |
|---|---|---|---|
| 1,561,206 | 11/1925 | Bixby | 242/118.41 |
| 2,771,849 | 11/1956 | Galbreath | 242/118.7 X |
| 3,176,932 | 4/1965 | Kovaleski | 242/118.41 X |
| 3,270,980 | 9/1966 | Philips | 242/118.7 |
| 3,339,857 | 9/1967 | Knibbs et al. | 242/18 R |
| 3,948,457 | 4/1976 | Spreitzer | 242/74 |
| 4,133,495 | 1/1979 | Dowd | 242/74 X |
| 4,611,638 | 9/1986 | Matumura | 242/74 X |

FOREIGN PATENT DOCUMENTS

| | | | |
|---|---|---|---|
| 239052 | 5/1965 | Fed. Rep. of Germany | 242/74 |
| 1952385 | 4/1971 | Fed. Rep. of Germany | 242/74 |
| 2825154 | 12/1979 | Fed. Rep. of Germany | 242/74 |
| 837152 | 6/1960 | United Kingdom | 242/118.41 |
| 2139986 | 11/1984 | United Kingdom . | |

*Primary Examiner*—Stanley N. Gilreath

*Attorney, Agent, or Firm*—Hill, Van Santen, Steadman & Simpson

[57] ABSTRACT

A spool for winding thereon a flexible elongate material includes a pair of diametrically opposite first pins projecting from one end of a hollow cylindrical body of the spool, a pair of diametrically opposite first recesses defined in said one end of the body, a pair of diametrically opposite second recesses defined in the other end of the body in alignment with the respective first pins, and a pair of diametrically opposite second pins projecting from said other end of the body and disposed in alignment with the first recesses. The first pins and recesses are complementary in shape to the second recesses and pins, respectively. With the pins and recesses thus constructed, the spool can be connected with the identical spools at opposite ends. The spools thus connected constitute a multi-spool winding unit which is driven by a single driving unit.

5 Claims, 5 Drawing Sheets

SPOOL FOR WINDING THEREON FLEXIBLE ELONGATE MATERIALS

BACKGROUND OF THE INVENTION

1. Field of the Invention

The present invention relates generally to spools for winding thereon flexible elongate materials, such as slide fastener stringer tapes, slide fastener chains, belts for garments, and ornamental tapes. More particularly, it relates to a spool suitable for use in multiple or parallel concurrent winding of such flexible elongate materials.

2. Prior Art

There are known various spools for winding thereon a tape-like flexible elongate material. However, the known spools are not axially connectable in construction and they are driven by drive units, respectively. Consequently, when a plurality of flexible elongate materials are to be wound concurrently on the known spools, a large area must be provided for installation of the individual driving units. Furthermore, an accurate control system is necessary for synchronous operation of the individual driving units with the result that a reliable parallel concurrent winding of the flexible elongate materials is difficult to achieve.

SUMMARY OF THE INVENTION

It is accordingly an object of the present invention to provide a spool having a structural features which enable axial connection with the identical spools to build up a multi-spool winding unit capable of being driven by a single drive unit for simultaneous winding of a plurality of flexible elongate materials on the axially connected spools of the winding unit.

According to the present invention, the foregoing and other objects are attained by a spool having a pair of diametrically opposite first pins projecting from one end of a hollow cylindrical body of the spool, a pair of diametrically opposite first recesses defined in said one end of the body, a pair of diametically opposite second recesses defined in the other end of the body in alignment with the respective first pins, and a pair of diametrically opposite second pins projecting from said other end of the body and disposed in alignment with the first recesses. The first pins and recesses are complementary in shape to the second recesses and pins, respectively. With the pins and recesses thus constructed, the spool can be connected with the identical spools at opposite ends. The spools thus connected constitute a multi-spool winding unit which is driven by a single driving unit.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
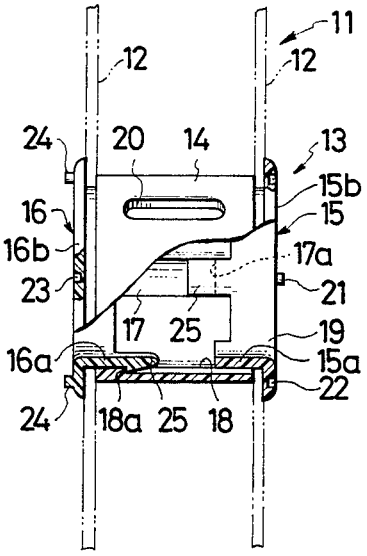
FIG. 1 is a front elevational view, partly in cross section, of a spool embodying the present invention.

As shown in FIG. 1, a spool 11 embodying the present invention includes a pair of annular discs or flanges 12, 12 disposed on opposite ends of a hollow cylindrical body 13 of the spool 11 and projecting radially outwardly from the body 13.

The spool body 13 is composed of a hollow cylindrical shaft 14 and a pair of hubs or end caps 15, 16 snappingly fitted in the shaft 14 from the opposite ends of the latter. The annular flanges 12, 12 are retained respectively on a pair of cylindrical stems **15*a*, 16*a* of the end caps 15, 16 and they are sandwiched between the oppsite end faces of the shaft 14 and a pair of annular bases 15*b*, 16*b* of the end caps 15, 16**.

Figure 4:
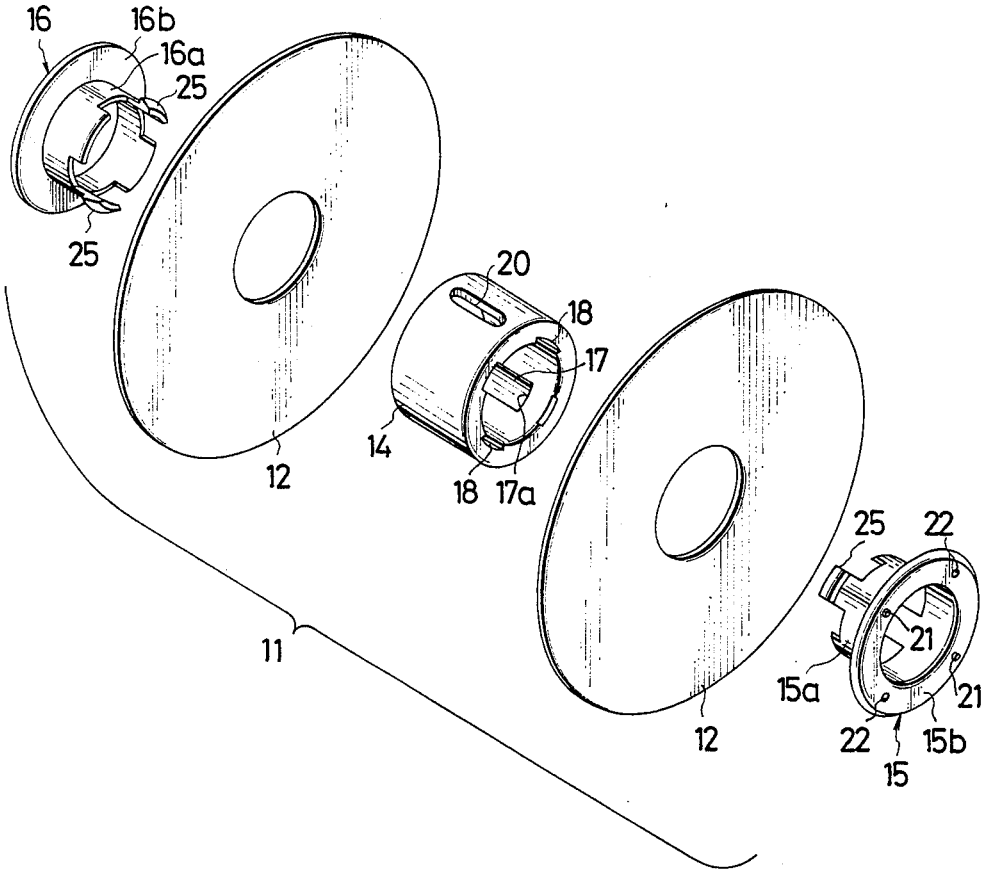
FIG. 4 is an exploded perspective view of the spool shown in FIG. 1.

As shown in FIGS. 1 and 4, the hollow cylindrical shaft 14 is molded of a synthetic resin and includes a pair of confronting first axial grooves 17, 17 defined in an inner peripheral surface of the shaft 14 and extending from one end (left end in these figures) of the shaft 14 toward the other end, the first axial grooves 17 terminating short of the other end of the shaft 14. The shaft 14 also includes a pair of confronting second axial grooves 18, 18 defined in the inner peripheral surface of the shaft 14. The second axial grooves 18 extend from the other end of the shaft 14 toward the one end and terminate short of the one end of the shaft 14. The first axial grooves 17 and the second axial grooves 18 are circumferentially displaced from one another by an angle of 90 degrees. Since the first and second axial grooves 17, 18 do not extend throughout the length of the shaft 14, there are provided four retaining surfaces **17*a*, 17*a*, 18*a*, 18*a* at inner terminal ends of the respective grooves 17, 17, 18, 18**.

The shaft 14 further has an axial slot or opening 20 extending radially through the peripheral wall of the shaft 14 and communicating with a hollow interior 19 of the shaft 14. The opening 20 serves as means for holding the leading end of a tape-like flexible elongate material T (FIG. 6) on the spool 11 at the begining of winding operation, as described later. Preferably, the opening 20 is disposed in a fixed angular positional relation to the axial grooves 17, 18.

Figure 3:
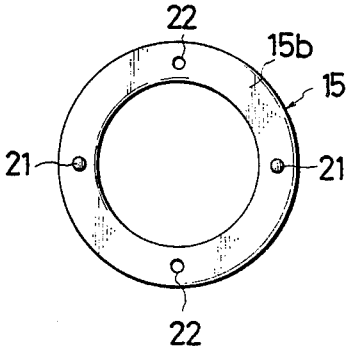
FIG. 3 is a right side view of FIG. 1.

The end cap 15 is molded of a synthetic resin and, as shown in FIGS. 1, 3 and 4, it includes a pair of diametrically opposite pins 21, 21 projecting from the annular base **15*b* in a direction away from the cylindrical stem 15*a*, and a pair of diametrically opposite recesses 22, 22 defined in the annular base 15*b* and opening away from the cylindrical stem 15*a*. The pins 21 and the recesses 22 are disposed in a circle concentric with the annular base 15*b* and are circumferentially displaced from one another by an angle of 90 degrees. The pins 21 have a cylindrical shape which is complementary to the shape of the recesses 22, the pins 21 and recesses 22 extending parallel to the axis of the end cap 15**.

Figure 2:
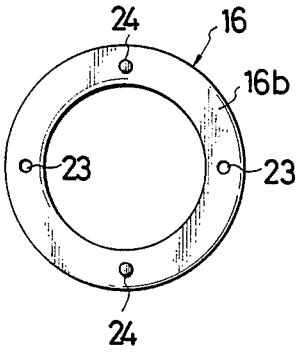
FIG. 2 is a left side view of FIG. 1.

Likewise, the end cap 16 is molded of a synthetic resin and, as shown in FIGS. 1 and 2, it includes a pair of diametrically opposite recesses 23, 23 defined in the annular base 16*b* in alignment with the pins 21 on the end cap 15 and opening away from the cylindrical stem 16*a*, and a pair of diametrically opposite pins 24, 24 projecting from the annular base 16*b* in a direction away from the cylindrical stem 16*a*, The recesses 23 and the pins 24 are circumferentially displaced from one another by an angle of 90 degrees so that the pins 24 are in alignment with the recesses 22 in the end cap 15. The pins 24 are identical in shape to the pins 21 on the end cap 15 and hence they are receivable in the recesses 22 in the end cap 15. The pins 21 on the end cap 15 are also receivable in the recesses 23 in the end cap 16.

As shown in FIGS. 1 and 4, each of the end cap 15, 16 has a pair of opposed locking arms 25, 25 projecting from an outer end of the stem 15*a*, 16*a* in a direction parallel to the axis of the annular end cap 15, 16. The locking arms 25 are resiliently deformable toward each other and lockingly engageable with the retaining surfaces 17*a*, 18*a* of the shaft 14. The locking arms 25 correspond in circumferential position to the pins 21, 24 on the end caps 15, 16.

To assemble the spool 11, the cylindrical stem 15*a* of the end cap 15 is fitted in one of the annular flanges 12 to retain the same thereon. Then the end cap 15 is inserted into the shaft 15 from the other end (right end in FIG. 1) thereof while holding the locking arms 25 in alignment with the axial grooves 17. During that time, the locking arms 25 are flexed inwardly toward each other until they arrive at the retaining surfaces 17*a* of the axial grooves 17 whereupon the locking arms 25 spring back or expand into axial grooves 17 and are brought into locking engagement with the retaining surfaces 17*a*, thereby joining the end cap 15 with the shaft 14.

Then the other annular flange 12 is retained on the end cap 16 which in turn is inserted in the shaft 14 from the left end thereof. During that time, the locking arms 25 of the end cap 16 are kept in alignment with the axial grooves 18. Consequently, the locking arms 25 are flexed inwardly against the resiliency thereof as they are forced into the shaft 14. When the locking arms 25 arrive at the retaining surfaces 18*a* of the axial grooves 18, they expand or spring back into the axial grooves 18 to join the end cap 16 with the shaft 14 via locking engagement between the locking arms 25 and the retaining surfaces 18*a*.

Since the axial grooves 17 and the axial grooves 18 are circumferentially displaced from one another by an angle of 90 degrees, the pins 21 and the recesses 22 of the end cap 15 are automatically brought into axial alignment with the recesses 23 and the pins 24 of the end cap 16, respectively, even though the end caps 15, 16 are identical in construction.

The annular flanges 12 may be replaced with another pair of flanges of a different diameter. As an alternative, the flanges 12 may be removed in which instance the end caps 15, 16 are directly fitted into the shaft 14.

Figure 5:
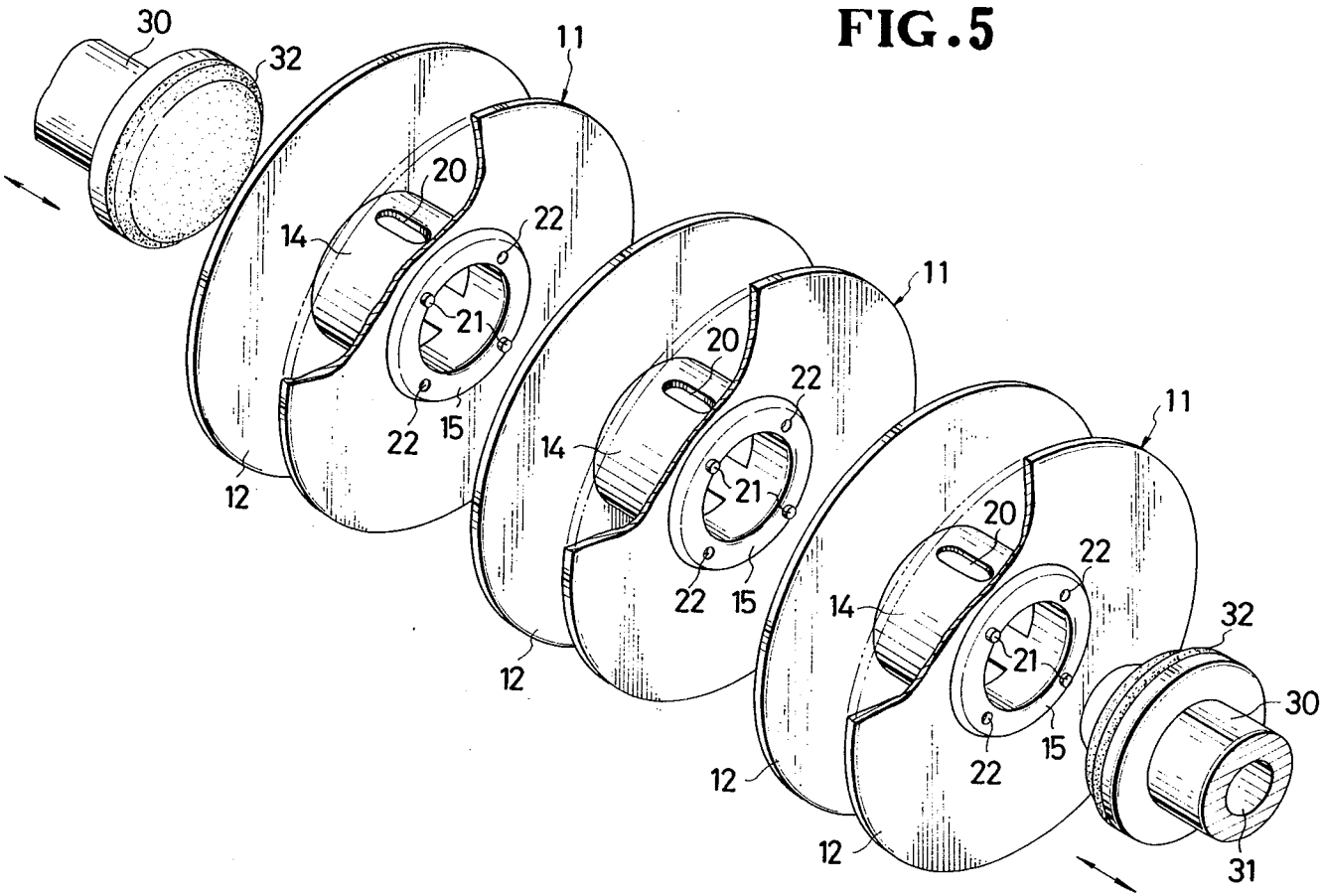
FIG. 5 is a perspective view, with parts omitted for clarity, of three identical spools before they are axially joined together to constitute a multi-spool winding unit for being driven by a drive unit.
Figure 6:
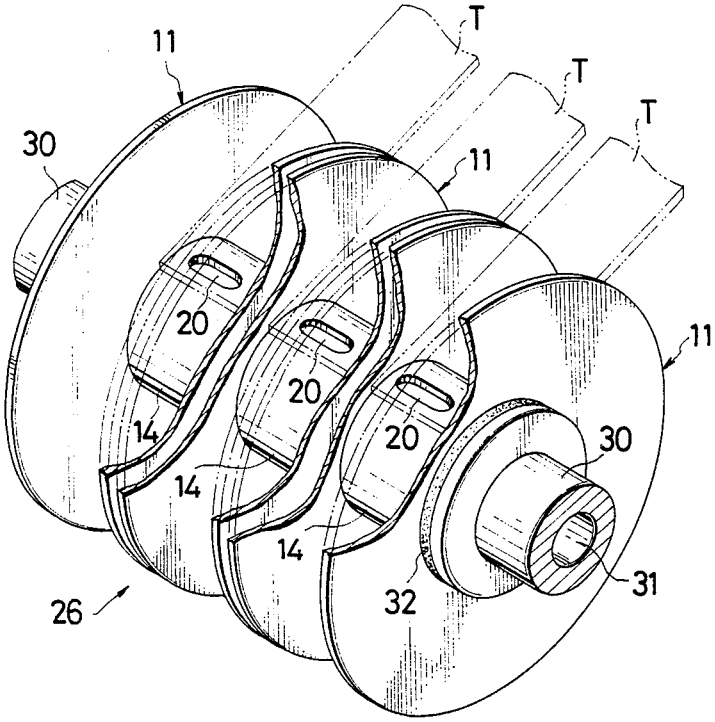
FIG. 6 is a view similar to FIG. 5, but showing the spools axially connected together on the drive unit.
Figure 7:
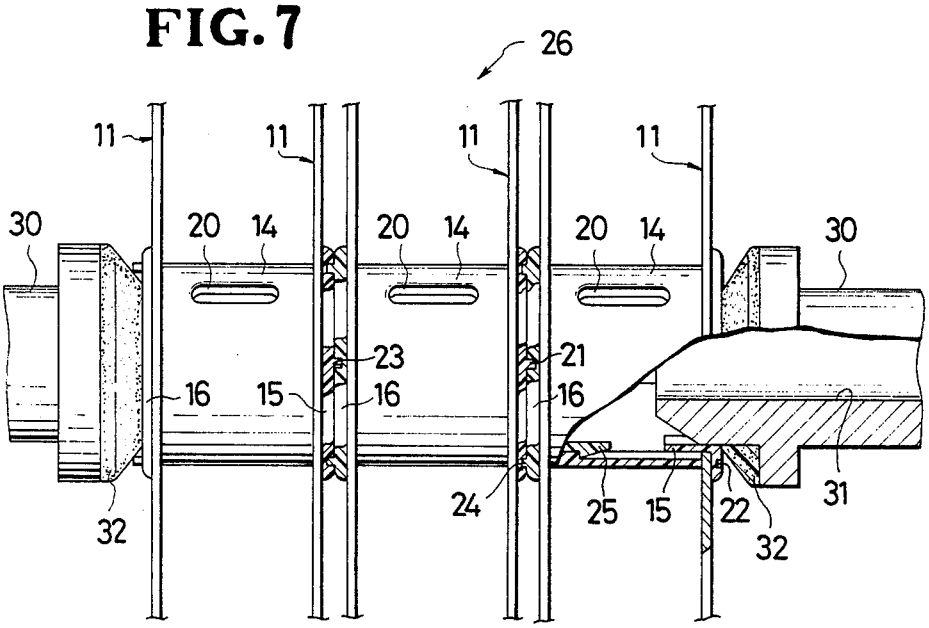
FIG. 7 is a front elevational view, partly in cross section, of FIG. 6.

FIGS. 5 through 7 show the manner in which the spool 11 of the foregoing construction is axially connected with two identical spools 11 via fitting engagement of the pins 21, 24 and the recesses 22, 23 so as to build up a multi-spool winding unit 26 (FIGS. 6 and 7). The spools 11 thus assembled into the multi-spool winding unit 26 can be rotated in unison by a single drive unit for winding concurrently thereon three tape-like flexible elongate materials T (FIG. 6). The drive unit comprises a pair of opposed drive shafts 30, 30 reciprocably movable toward and away from one another to detachably hold the multi-spool winding unit 26 therebetween. The shafts 30 are driven by a suitable drive means (not shown) to rotate the winding unit 26. One of the shafts 30 is solid while the other shaft 30 is hollow and has an axial hole 31 connected in fluid communication with a suitable vacuum source such as a vacuum pump, not shown.

Figure 8:
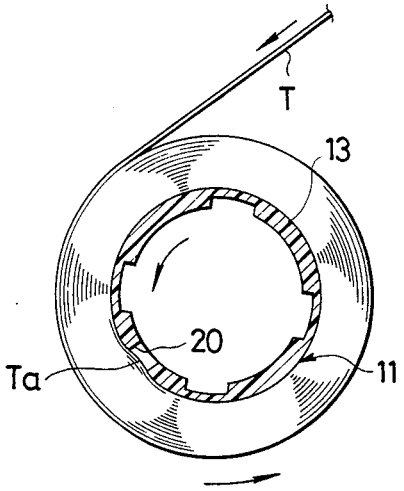
FIG. 8 is a transverse cross-sectional veiw of one of the spools of FIG. 7, illustrating the manner in which a flexible elongate material is wound on the spool.

In operation, the multi-spool winding unit 26 is held by and between the drive shafts 30 with a pair of elastic seal-and-friction discs 32, 32 of soft synthetic rubber interposed between the unit 26 and the shafts 30. Then the non-illustrated vacuum pump is operated to exhaust air from the interior of the spools 11. Due to the vacuum thus created, the external atmospheric pressure forces the surrounding air into the axial hole 31 through the axial openings 20 of the respective spools 11. This airflow also produces a vacuum over an outer surface of each spool 11 in the vicinity of the axial opening 20. Then the flexible elongate materials T are supplied over the corresponding spools 11. In this instance, the leading ends Ta of the respective flexible elongate materials T are sucked toward the axial openings 20 and then adhered to the outer surface of the spools 11, due to the vacuum or negative pressure created in the vicinity of the axial openings 20 and in the interior of the spools 11. Thereafter, the drive shafts 30 are driven to rotate the multi-spool winding unit 20, thereby winding the elongate materials T concurrently on the spools 11 in the manner as shown in FIG. 8. Since the axial openings 20 of the spools 11 are disposed in a fixed positional relation to the axial grooves 17, 18 of the shafts 14 and hence to the pins 21, 24 and recesses 22, 23, they extend in alignment with each other. This arrangement is advantageous because all the leading ends Ta of the elongate materials T are simultaneously held on the spools 11.

Figure 9:
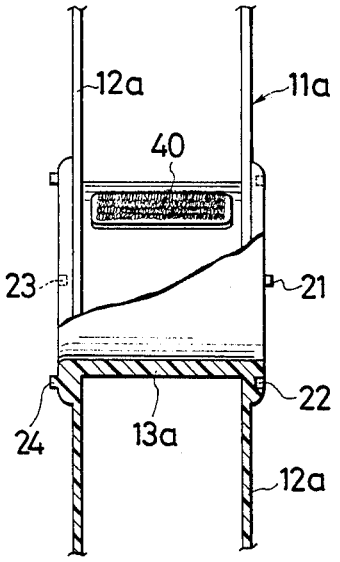
FIG. 9 is a view similar to FIG. 1, but showing a modified spool.
Figure 10:
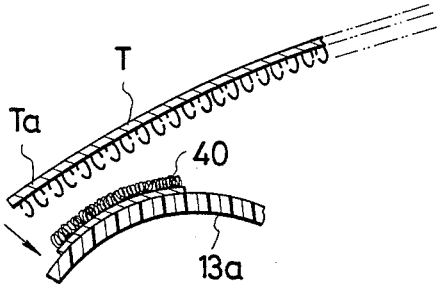
FIG. 10 is an enlarged fragmentary cross-sectional view of the spool of FIG. 9, showing the manner in which the leading end of a flexible elongate material is fixed on the spool.

FIG. 9 shows a modified spool 11*a* which comprises a pair of annular flanges 12*a*, 12*a* and a hollow cylindrical body 13*a* integrally formed of a synthetic resin. Due to this integral formation, the spool 11*a* does not have a detachable end cap on either end or an axial groove defined in the spool body 13*a*. The spool body 13*a* includes a pair of diametrically opposite pins 21, 21; 24, 24 and a pair of diametrically opposite recesses 22, 22; 23, 23 on each of its opposite end faces. The dimensions of and positional relationship between the pins 21, 24 and the recesses 22, 23 are the same as those with the pins 21, 24 and the recesses 22, 23 of the spool 11 shown in FIG. 1. The spool 11*a* also includes a strip 40 of a looped fabric tape attached to an outer peripheral surface of the spool body 13*a* and disposed in a fixed angular relation to the pins 21, 24 and recesses 22, 23. The looped fabric strip 40 serves as means for holding the leading end Ta of an elongate hooked fabric tape T, as shown in FIG. 10.

Obviously, many modifications and variations of the present invention are possible in the light of the above teachings. It is therefore to be understood that within the scope of the appended claims, the invention may be practiced otherwise than as specifically described.

What is claimed is:

1. A spool for winding thereon a flexible elongate material, comprising:

(a) a hollow cylindrical body including a hollow cylindrical shaft and a pair of annular end caps detachably mounted on opposite ends of said shaft;

(b) a pair of diametrically opposite first pins projecting from one of said end caps;

(c) a pair of diametrically opposite first recesses formed in said one end cap;

(d) a pair of diametrically opposite second recesses defined in the other of said end caps in alignment with said first pins, respectively, and having a shape complementary to the shape of said first pins; and (e) a pair of diametrically opposite second pins projecting from the other of said end caps and disposed in alignment with said first recesses, respectively, said second pins having a shape complementary to the shape of said first recesses.

2. A spool according to claim 1, further including a pair of annular flanges detachably held between the opposite ends of said shaft and said end caps, respectively.

3. A spool according to claim 1, said end caps being snappingly fitted in said shaft.

4. A spool according to claim 1, each of said end caps including a pair of confronting, resiliently flexible locking arms corresponding in circumferential position to one pair of said first pins, said first receses, said second recesses and said second pins, said hollow cylindrical shaft having a pair of confronting first axial grooves defined in an inner peripheral surface of said shaft and extending from one end of said shaft toward the other end and terminating short of said other end of said shaft, and a pair of confronting second axial grooves defined in said inner peripheral surface of said shaft and extending from said other end of said shaft toward said one end and terminating short of said one end of said shaft, said resilient locking arms of one of said end caps being snappingly fittable in said first axial grooves, said resilient locking arms of the other end caps being snappingly fittable in said second axial grooves.

5. A spool according to claim 4, said first axial grooves and said second axial grooves being circumferentially displaced from one another by an angle of 90 degrees.

* * * * *